United States Patent [19]

Schäfer et al.

[11] Patent Number: 4,644,216

[45] Date of Patent: Feb. 17, 1987

[54] HIGH-PRESSURE DISCHARGE LAMP

[76] Inventors: Ralf Schäfer, Büchel 34, 5100 Aachen; Hans P. Stormberg, Weissdornweg 52, 5190 Stolberg, both of Fed. Rep. of Germany

[21] Appl. No.: 725,980

[22] Filed: Apr. 22, 1985

[30] Foreign Application Priority Data

May 5, 1984 [DE] Fed. Rep. of Germany ..... 3416714

[51] Int. Cl.[4] ..... H01J 61/52; H01K 1/58

[52] U.S. Cl. ..... 313/25; 313/27

[58] Field of Search ..... 313/25, 26, 27

[56] References Cited

U.S. PATENT DOCUMENTS 1,145,837 7/1915 Hoff ..... 313/25 X
1,171,509 2/1916 Essich ..... 313/25 X
2,103,028 12/1937 Bol ..... 313/26
2,175,361 10/1939 Reger et al. ..... 313/25
4,410,828 10/1983 Ernest ..... 313/26 X

FOREIGN PATENT DOCUMENTS 16456 1/1983 Japan ..... 313/25

*Primary Examiner*—Stewart J. Levy
*Assistant Examiner*—Joseph W. Roskos
*Attorney, Agent, or Firm*—Thomas A. Briody; Robert T. Mayer

[57] ABSTRACT

In a high-pressure discharge lamp having a straight tubular intermediate part (10) of quartz, glass or another material of poor thermal conduction arranged between the outer bulb (4) and the lamp base (7), the intermediate part is folded into the shape of a bellow. With respect to a cylindrical intermediate part, the length of the lamp is thus decreased.

6 Claims, 1 Drawing Figure

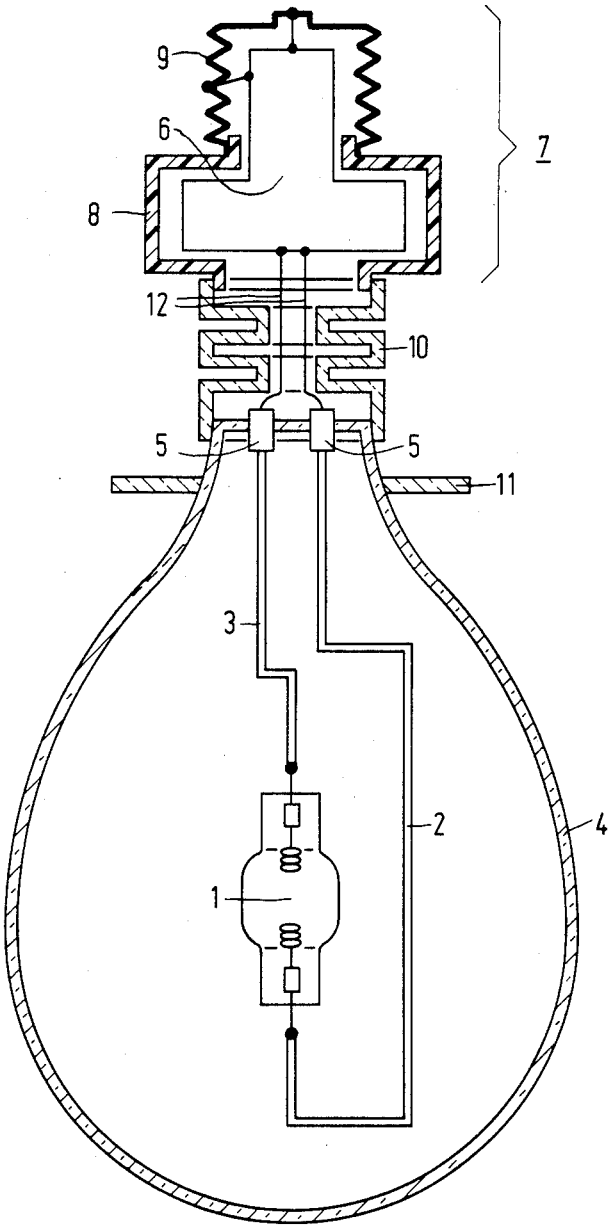
9
6
7
8
12
10
5
5
11
3
2
4
1

HIGH-PRESSURE DISCHARGE LAMP

The invention relates to a high-pressure discharge lamp having a straight tubular intermediate part of a material of poor thermal conduction, preferably of glass or quartz, arranged between the outer bulb and the lamp base.

In high-pressure discharge lamps, for example in sodium, mercury or metal halide high-pressure discharge lamps, the problem arises of overheating of the lamp base and any parts contained therein, especially in a vertical operating position with the lamp base pointing upwards. The lamp base may consist either only of the actual lamp cap or of the lamp cap and of an additional hollow body arranged between this lamp cap and the outer bulb. In the outer bulb either the discharge may take place immediately or a separate discharge tube may be arranged.

It is known in more recently developed discharge lamps to accommodate an electronic ballast or ignition element in the lamp base (DE-OS 2939632). Although the lamp cap is then covered by a heat-isolating plate, it is in immediate thermal contact with the outer bulb. Thus, the lamp cap can be heated to more than 150° C., which would lead to a destruction of the electronic elements present in the lamp cap. Moreover, in this case also a very heatresistant holder is required.

U.S. Pat. No. 2,103,028 discloses a high-pressure discharge lamp, in which for protection of the lamp cap from heat conduction from the actual lamp bulb there is arranged between this bulb and the cap a cylindrical length of tubing of glass, which will prevent the heat transport to the cap due to its small wall thickness and its large length. However, such intermediate parts cause the whole lamp to become very long and to be mechanically unstable.

The invention therefore has for its object to provide a high-pressure discharge lamp having an intermediate part of poor thermal conduction, which not only prevents an overheating of the lamp, but also does not substantially enlarge the overall dimensions of the lamp.

According to the invention, this object is achieved in a high-pressure discharge lamp of the kind mentioned in the opening paragraph in that the intermediate part is folded into the shape of a bellow. Thus, comparatively short intermediate parts are obtained, which nevertheless have a high thermal resistance.

Preferably, the intermediate part has a meandering form. The intermediate part may alternatively be in the form of a corrugated tube. In both cases, the intermediate part is mechanically very stable.

In order that the invention may be readily carried out, it will now be described more fully, by way of example, with reference to the accompanying drawing, which is a longitudinal sectional view of a high-pressure discharge lamp not drawn to scale.

The discharge lamp has a discharge tube 1, which is accommodated by means of pole wires 2 and 3 in an outer bulb 4 of glass, which is evacuated or is filled with a gas. The pole wires 2 and 3 are secured to electrical lead-through members 5, which are sealed into the wall of the outer bulb 4 and which are again connected via lead-in wires 12 to an electronic ballast or ignition unit 6, which is arranged in a lamp base 7, which comprises a hollow body 8 and a lamp cap 9 connected thereto. The hollow body 8 may be filled with gas or be evacuated. The outer bulb 4 is connected to the lamp base 7 through an intermediate part 10 of glass, which has a meandering form. The intermediate part 10 thus has a comparatively small overall length, but a large length for the thermal conduction, so that there is a substantial heat resistance between the hot outer bulb 4 and the hollow body 8 comprising the electronic unit 6. Thus, in the operating position of the lamp shown, an overheating leading to destruction or to reduction of life of the elements in the electronic unit 6 is prevented. For this purpose, in general temperatures below 80° to 100° C. have to be aimed at.

The intermediate part 10 is connected preferably by gluing to the outer bulb 4 and to the hollow body 8. A further reduction of the heat current from the outer bulb 4 to the lamp base 7 can be attained in that the intermediate part 10 is glued to the outer bulb and to the lamp base respectively, not along the whole circumference of its end faces, but only along such part of its end faces which is sufficient for holding it mechanically.

The lamp base 7 and the electronic unit 6 contained therein are heated not only by heat conduction from the outer bulb, but also by hot gas rising from the outer bulb. In order to protect the lamp cap 7 from such hot gases, an annular heat shield 11 projecting outwards as a flange is arranged on the outer bulb 4 at its end facing the lamp base. This heat shield 11 may consist of glass and may be connected to the outer bulb 4 by gluing, cementing or fusion.

What is claimed is:

1. A high-pressure discharge lamp with a longitudinal axis comprising an outer bulb containing a discharge tube, a lamp base containing an electronics unit for driving the discharge tube, and a tubular intermediate part made of a material of poor thermal conduction and arranged between the outer bulb and the lamp base, characterized in that the intermediate part is folded as a bellows having a comparatively small overall length along the lamp axis, but a large length for thermal conduction, so that it provides a substantial heat resistance between the heated outer bulb and the electronics unit in the lamp base.

2. A lamp as claimed in claim 1, characterized in that the intermediate part has a meandering form.

3. A lamp as claimed in claim 2, characterized in that a flange is arranged on the outer bulb at its end facing the lamp base.

4. A lamp as claimed in claim 1, characterized in that the intermediate part is in the form of a corrugated tube.

5. A lamp as claimed in claim 4, characterized in that a flange is arranged on the outer bulb at its end facing the lamp base.

6. A lamp as claimed in claim 1, characterized in that a flange is arranged on the outer bulb at its end facing the lamp base.

* * * * *